US006554569B2

(12) United States Patent
Decker et al.

(10) Patent No.: US 6,554,569 B2
(45) Date of Patent: Apr. 29, 2003

(54) COMPRESSOR OUTLET GUIDE VANE AND DIFFUSER ASSEMBLY

(75) Inventors: John J. Decker, Liberty Township, OH (US); Andrew Breeze-Stringfellow, Cincinnati, OH (US); Peter N. Szucs, West Chester, OH (US)

(73) Assignee: General Electric Company, Schenectady, NY (US)

( * ) Notice: Subject to any disclaimer, the term of this patent is extended or adjusted under 35 U.S.C. 154(b) by 22 days.

(21) Appl. No.: 09/932,323

(22) Filed: Aug. 17, 2001

(65) Prior Publication Data

US 2003/0035723 A1 Feb. 20, 2003

(51) Int. Cl.[7] ..... F01D 9/04
(52) U.S. Cl. ..... 415/192; 415/211.2; 415/914
(58) Field of Search ..... 415/182.1, 185, 415/191, 192, 207, 208.1, 208.2, 211.2, 215.1, 914

(56) References Cited

U.S. PATENT DOCUMENTS

| | | | | |
|---|---|---|---|---|
| 3,945,759 | A | | 3/1976 | Bobo |
| 4,483,149 | A | | 11/1984 | Rider et al. |
| 4,826,400 | A | | 5/1989 | Gregory |
| 5,074,752 | A | | 12/1991 | Murphy et al. |
| 5,077,967 | A | | 1/1992 | Widener et al. |
| 5,088,892 | A | | 2/1992 | Weingold et al. |
| 5,165,850 | A | | 11/1992 | Humke et al. |
| 5,167,489 | A | | 12/1992 | Wadia et al. |
| 5,249,921 | A | | 10/1993 | Stueber et al. |
| 5,335,501 | A | | 8/1994 | Taylor |
| 5,342,170 | A | | 8/1994 | Elvekjaer et al. |
| 5,575,620 | A | * | 11/1996 | Haller et al. ..... 415/192 |
| 5,592,821 | A | | 1/1997 | Alary et al. |
| 5,725,354 | A | | 3/1998 | Wadia et al. |
| 6,036,438 | A | * | 3/2000 | Imai ..... 415/192 |
| 6,195,983 | B1 | | 3/2001 | Wadia et al. |

OTHER PUBLICATIONS

"Spanwise Mixing in Axial–Flow Turbomachines" by G.G. Adkins, Jr. and L.H. Smith, Jr., Reprinted from Jan. 1982, vol. 104, Journal of Engineering for Power, pp. 97–110.

* cited by examiner

*Primary Examiner*—Edward K. Look
*Assistant Examiner*—Richard A. Edgar
(74) *Attorney, Agent, or Firm*—Nathan D. Herkamp; Steven J. Rosen

(57) ABSTRACT

A gas turbine engine outlet guide vane assembly has annular inner and outer end walls, a flowpath between the inner and outer end walls, outlet guide vanes radially disposed between the inner and outer end walls, and boundary layer energizing means for energizing boundary layers using secondary flow to mix free stream flow into the boundary layers along the inner and outer end walls and suction and pressure sides of the vanes. The boundary layer energizing means includes having the vanes circumferentially leaned in a direction that the suction sides face. The boundary layer energizing means also includes swept leading and/or trailing edges of the vanes that extend radially between the inner and outer end walls. The swept leading and/or trailing edges may be curved inwardly into the vanes from the outer end walls to leading and/or trailing edge points respectively between the end walls. The boundary layer energizing means also includes vanes that are bowed circumferentially outwardly in a circumferential direction and more particularly vanes that are bowed circumferentially outwardly in a circumferential direction the pressure sides face.

41 Claims, 5 Drawing Sheets

COMPRESSOR OUTLET GUIDE VANE AND DIFFUSER ASSEMBLY

BACKGROUND OF THE INVENTION

1. Field of the Invention

The present invention relates generally to gas turbine engine compressor outlet guide vanes and diffuser assemblies and, more specifically, to aerodynamically efficient vanes of the assembly.

2. Background Art

A conventional gas turbine engine includes in serial flow communication a compressor, a discharge flowpath having a stage of compressor outlet guide vanes (OGVs), disposed between annular inner and outer walls, which in turn are mounted in an OGV support structure mechanically tied into an engine casing. Outlet guide vanes typically have airfoil like cross-sections that include a leading edge, a relatively thick middle section, and a thin trailing edge. Downstream of the OGVs is a combustor diffuser, a combustor, a turbine nozzle, and a high pressure turbine. Typically, OGV inner and outer walls are supported by corresponding inner and outer annular diffuser inlet walls to form a relatively leak-free flowpath therebetween and support the OGVs and diffuser. The OGVs, inner and outer walls, and diffuser may be a single piece, integrally cast assembly or in some other constructions corresponding inner and outer OGV walls with the OGVs therebetween are welded to a diffuser casing.

During engine operation, the compressor compresses inlet airflow, which is therefore heated thereby. The discharged compressed and heated airflow is then channeled through the OGVs and the diffuser to the combustor wherein it is conventionally mixed with fuel and ignited to form combustion gases. The combustion gases are channeled through the turbine nozzle to the high pressure turbine which extracts energy therefrom for rotating and powering the compressor.

Typically, the high pressure air at the compressor exit is conditioned to have low swirl and low Mach number for use in the combustor and the outlet guide vanes and diffuser are employed to condition the compressor discharge air to be suitable for the combustor. Some engine configurations also require the OGVs to serve as a structural member which places additional constraints on the design. Conventionally, outlet guide vanes reside in a constant annulus height flowpath. The flowpath may help turn the flow radially outwardly to help align it with the downstream combustor. The OGVs are designed to remove tangential swirl from the compressor discharge air so that upon leaving the OGVs air flows nominally in the axial direction. In the process of deswirling, the flow's tangential momentum is converted to static pressure, reducing the flow's absolute Mach number. The diffuser is defined as the flowpath section downstream of the OGV trailing edge, which further decreases the flow Mach number by one or by a plurality of divergent annular passages. These passages may also guide the flow radially outwardly, providing yet more diffusion for a given annulus height. Adequate efficiency and stall margin are obtained by employing sufficient airfoil solidity, selecting proper airfoil incidence, optimizing the surface velocity distributions, and providing enough diffuser length/area ratio to avoid flow separation. High efficiency and reduced length typically requires reduced airfoil solidity and diffuser length to reduce wetted area and, therefore, reduce drag. For a given static pressure rise requirement, this loads the surface boundary layers bringing them closer to separation.

It is desirable to supply high pressure compressor exit air to the combustor as efficiently as possible with sufficient stall margin while minimizing engine length and hence weight and cost. Reduced length typically results in higher diffusion rates which makes the boundary layers more susceptible to separation which negatively impact performance and stall margin. Thus, reduced length and low diffusion rates tend to be conflicting requirements. In order to gain a competitive advantage it is desirable to reduce the axial length required to deliver this air and hence to reduce engine length, weight, and cost while maintaining performance and stall margin.

SUMMARY OF THE INVENTION

A gas turbine engine outlet guide vane assembly has annular inner and outer end walls, a flowpath between the inner and outer end walls, outlet guide vanes radially disposed between the inner and outer end walls, and a boundary layer energizing means for energizing boundary layers using secondary flow to mix free stream flow into the boundary layers along the inner and outer end walls and suction and pressure sides of the vanes. Secondary flow is any flow not in a direction of the primary flow. Free stream flow is any flow outside of the boundary layers. Secondary flow and primary flow are discussed in great detail in an article entitled "Spanwise Mixing in Axial-Flow Turbomachines" by Adkins and Smith in the January 1982 volume of the Journal of Engineering for Power, pages 104–110. The vanes have pressure and suction sides and a first boundary layer energizing means includes the vanes being circumferentially leaned in a circumferential direction that the suction sides face. A second boundary layer energizing means includes swept leading and/or trailing edges of the vanes which extend radially between the inner and outer end walls. In a more particular embodiment of the invention, the swept leading and/or trailing edges the are curved inwardly into the vanes from the outer end walls to leading and trailing edge points, respectively, that are located between the end walls. A third boundary layer energizing means includes the vanes being bowed circumferentially outwardly such as in a circumferential direction the pressure side is facing. The exemplary embodiment of the invention incorporates all of these boundary layer energizing means. The invention also includes a diverging flowpath between said leading and trailing edges.

The outlet guide vane assembly may be used in a gas turbine engine outlet guide vane and diffuser assembly having integral outlet guide vane and diffuser sections which share common annular inner and outer end walls radially bounding the sections and the flowpath between the inner and outer end walls. The outlet guide vane section is located forward of the diffuser section and includes the outlet guide vane assembly with the outlet guide vanes radially disposed between the inner and outer end walls. The boundary layer energizing means enhances secondary flow mixing of boundary layers along the inner and outer end walls and the suction and pressure sides of the vanes. The diffuser section can include struts extending radially across the flowpath between the inner and outer end walls in the diffuser section and/or annular flow separators.

The invention provides a design that reduces the axial length of the outlet guide vane and diffuser assembly used to deliver compressor air to a combustor which has been deswirled and diffused. The invention reduces engine length, weight, and cost while maintaining acceptable levels of engine performance and stall margin.

BRIEF DESCRIPTION OF DRAWINGS

The novel features characteristic of the invention are set forth and differentiated in the claims. The invention, in accordance with preferred and exemplary embodiments, is more particularly described in the following detailed description taken in conjunction with the accompanying drawing in which:

DETAILED DESCRIPTION OF THE INVENTION

Figure 1:
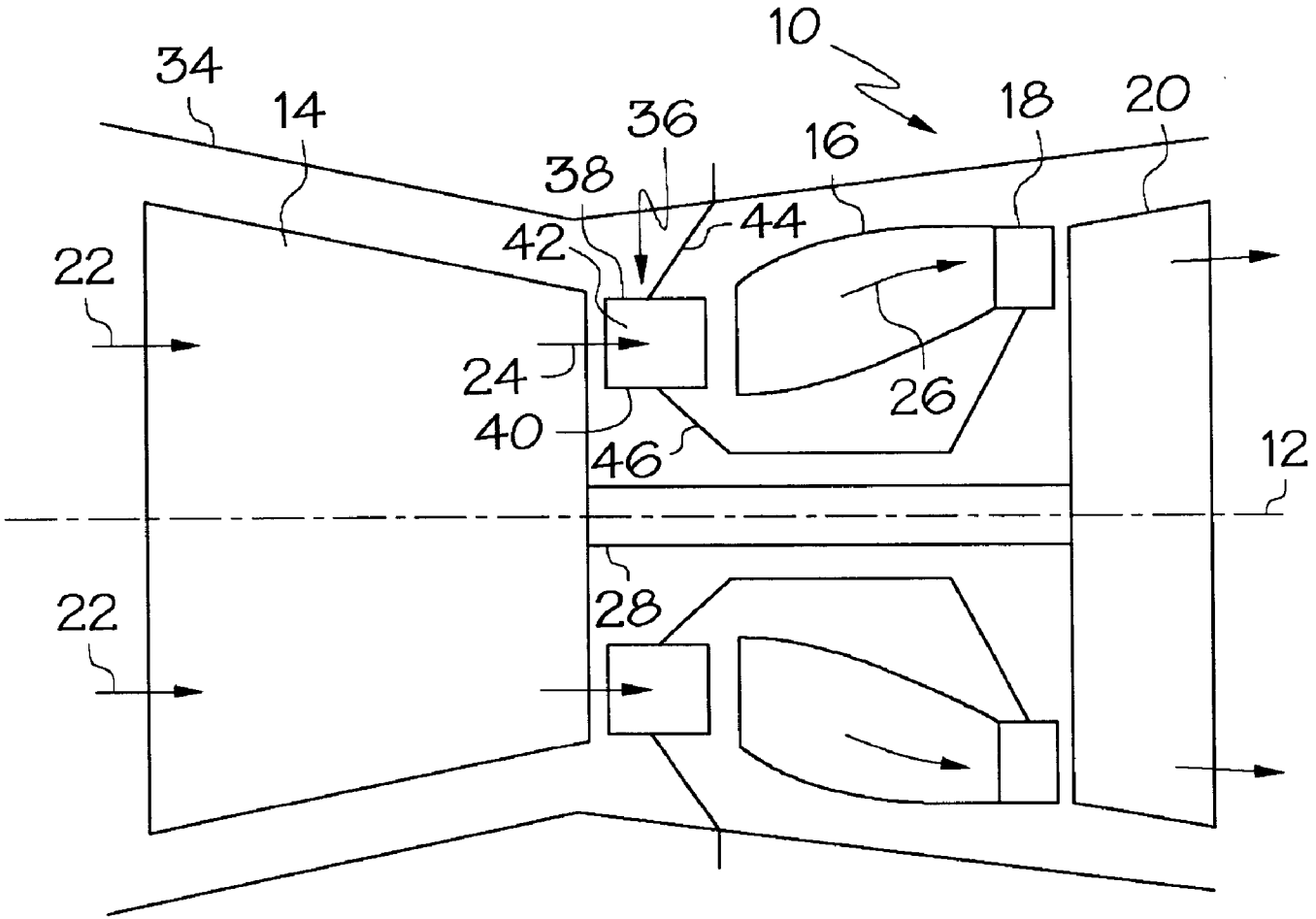
FIG. 1 is a schematic representation of an axial flow gas turbine engine including a compressor discharge flowpath in accordance with an exemplary embodiment of the present invention.

Illustrated in FIG. 1 is a schematic representation of a gas turbine engine 10 including in serial flow communication about an axial centerline axis 12 conventional annular and axisymmetric structures including an axial flow compressor 14, combustor 16, high pressure turbine nozzle 18, and high pressure turbine (HPT) 20. The compressor 14 receives inlet airflow 22 and compresses it. The compression generates relatively hot compressed airflow 24 which is flowed through a gas turbine engine compressor outlet guide vane and diffuser assembly 36 to the combustor 16 in which it is conventionally mixed with fuel and ignited for generating combustion gases 26. The gases 26 are flowed into the nozzle 18 and then flowed through the HPT 20 which extracts energy therefrom for rotating the HPT 20 which in turn rotates and powers the compressor 14 through a shaft 28.

Figure 3:
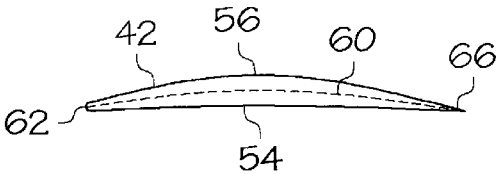
FIG. 3 is a radial transverse view illustration of the compressor outlet guide vane through 3—3 in FIG. 2.
Figure 2:
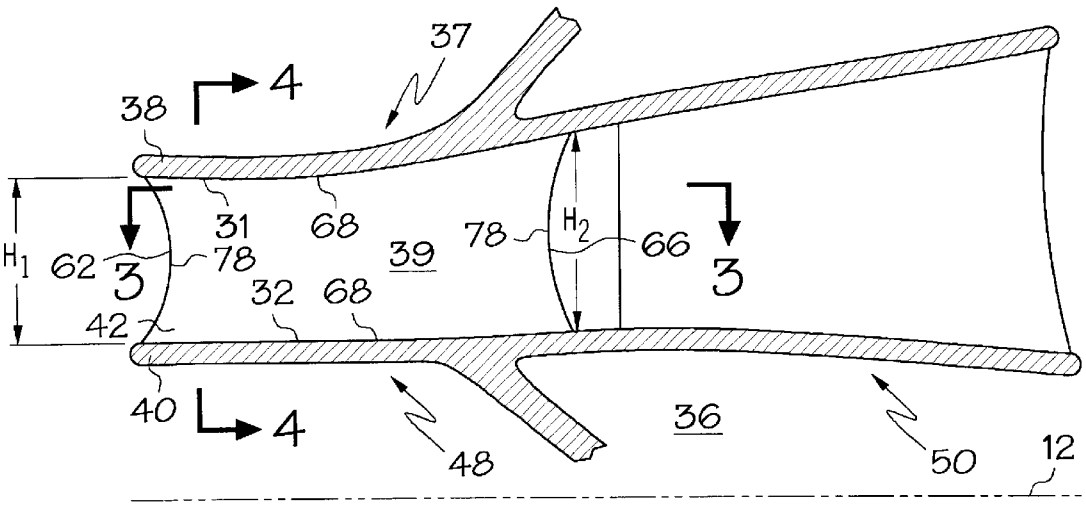
FIG. 2 is an enlarged axial transverse view illustration of the compressor outlet guide vane and diffuser assembly illustrated in FIG. 1.
Figure 5:
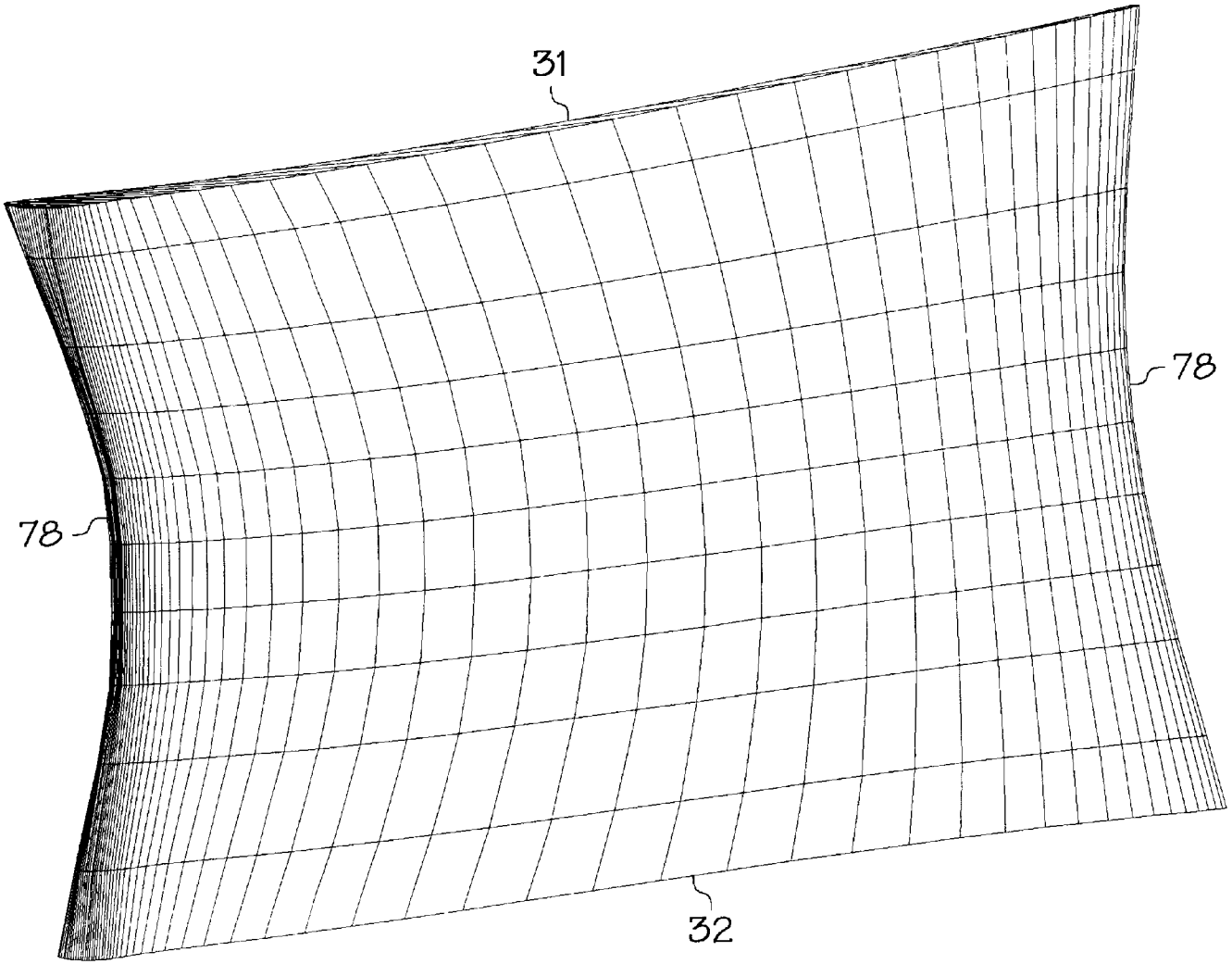
FIG. 5 is a wire frame schematic perspective view illustration from a side of the outlet guide vane of the assembly illustrated in FIG. 2.

Illustrated in more detail, FIGS. 2 and 3 is the outlet guide vane and diffuser assembly 36 having integral compressor outlet guide vane and diffuser sections 48 and 50, respectively, in which the outlet guide vane section is located forward of the diffuser section. The outlet guide vane section 48 has a compressor outlet guide vane (OGV) assembly 37 which includes a plurality of circumferentially spaced radially extending compressor outlet guide vanes (OGVs) 42 extending radially across a flowpath 39 between outer and inner annular end walls 38 and 40, respectively, which are disposed coaxially about the centerline axis 12. The OGVs 42 are fixedly joined to the outer and inner annular end walls 38 and 40. The outlet guide vanes 42 have airfoil cross-sections 60 with a camber line 61 and pressure and suction sides 54 and 56, respectively, which extend axially between leading edges 62 and trailing edges 66.

Figure 8:
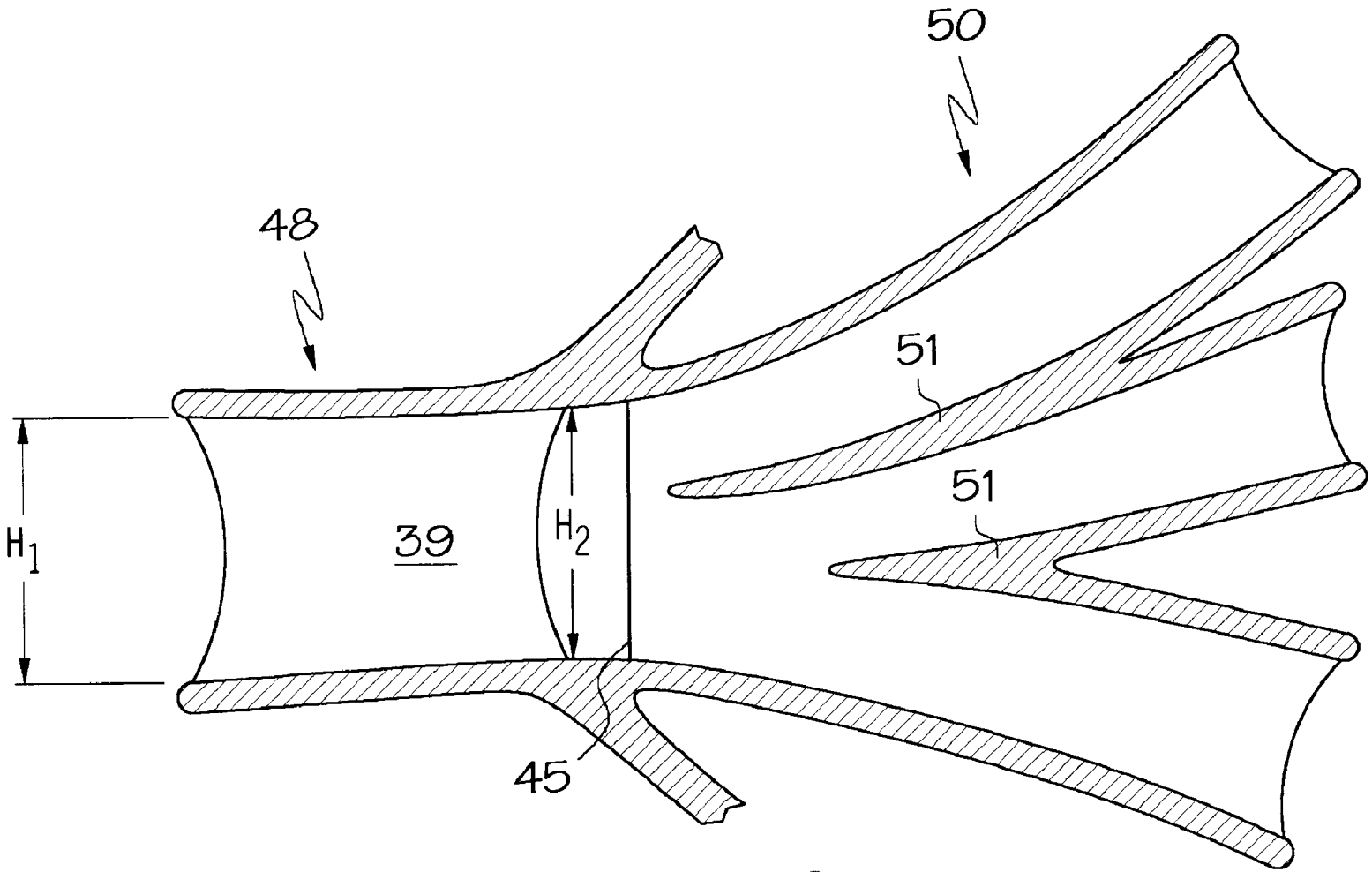
FIG. 8 is an enlarged axial transverse view illustration of an alternative compressor outlet guide vane and diffuser assembly illustrated in FIG. 1.

The diffuser section 50 extends downstream from the OGVs 42. An outer diffuser support 44 extends axially aftwardly and radially outwardly from the outer annular end wall 38 and is fixedly joined to a radially outer engine casing 34. An annular inner diffuser support 46 extends axially aftwardly and radially inwardly from the inner annular end wall 40 to a radially inner engine casing 41 and the turbine nozzle 18 (shown in FIG. 1). The outlet guide vane and diffuser assembly 36, having the integral outlet guide vane and diffuser sections 48 and 50 respectively, is an integral unit that may be fabricated by welding or other joining methods. In the exemplary embodiment of the present invention assembly, the outlet guide vane and diffuser assembly 36 is integrally formed such as by casting as a single piece. The outlet guide vane assembly 37 may also be a separate integral unit fabricated by welding or other joining methods. In the exemplary embodiment of the present invention assembly, it is integrally formed such as by casting as a single piece. In an alternative embodiment of the invention illustrated in FIG. 8, the diffuser section 50 has radially extending struts or dividers 45 and/or annular flow separators 51.

Referring again to FIG. 2, one of the design features of the present invention is a diverging flowpath 70 in the outlet guide vane section 48 of the OGV assembly. The diverging flowpath 70 is illustrated by a first annular height H1 at about the leading edge 62 and a second annular height H2 at about the trailing edge 66 of the OGV 42 and wherein the second annular height is greater than the first annular height. Divergence is more specifically and accurately measured by ratio of areas of the annuli at about the leading and trailing edges 62 and 66. For illustrative purposes, the areas of the annuli are represented herein by the first and second annular heights H1 and H2.

Figure 4:
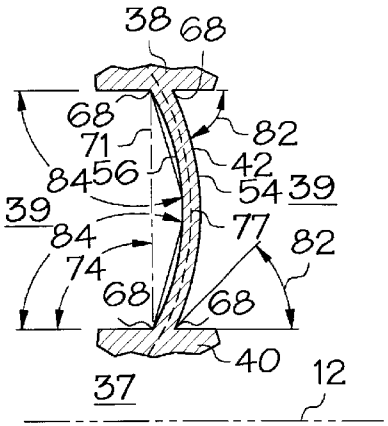
FIG. 4 is an axial cross-sectional view of the compressor outlet guide vane through 4—4 in FIG. 2.

Referring to FIGS. 2 and 4, the invention includes a boundary layer energizing means for energizing boundary layers using secondary flow to mix free stream flow 33 into the boundary layers along the inner and outer end walls (40, 38) and suction and pressure sides (54, 56) of the vanes 42. Features of the invention are designed to promote the mixing especially near junctions 68 of the vanes 42 and the outer and inner annular end walls 38 and 40, respectively. The junctions 68 at the outer and inner annular end walls 38 and 40 correspond to a tip 31 and a base 32, respectively, of the OGV 42. Energizing the boundary layers using secondary flow mixing allows the boundary layers to tolerate more diffusion before separation occurs. This extra diffusion is used to reduce the diffuser area ratio while achieving the same diffuser exit area. A smaller diffuser area ratio affords a shorter diffuser for equivalent loading, resulting in a shorter overall gas turbine engine configuration. This is also manifested in additional end wall divergence or a diverging flowpath 70 within the flowpath 39 through the outlet guide vane section 48.

The exemplary embodiment includes several boundary layer energizing means which may be used individually or together as in the exemplary embodiment illustrated herein. The first means includes having the outlet guide vanes (OGVs) 42 circumferentially leaned in a direction that the suction sides 56 faces as illustrated in FIG. 4. Another way of viewing this is that the suction sides 56 are tilted, canted, angled, or leaned in a circumferential direction that the suction sides face at a lean angle 74 in FIG. 4. The lean angle 74 is a measure of the lean of the vane 42 and may be viewed as an angle formed by a stacking axis 71 of the vane with respect to a tangent 75 to the inner annular end wall 40 which is perpendicular to an engine radius R extending radially outward from the axial centerline axis 12. The stacking axis 71 is a line connecting airfoil cross section center of gravities (CGs) of at a tip 31 and a base 32 of the vane 42. Lean is a rotation of the vane 42 about the base 32 causing the stacking axis to diverge from the engine radius R. A blade axis 77 of the OGV 42 illustrated herein is bowed or curved.

Another boundary layer energizing means includes having the leading and/or trailing edges, 62 and 66, swept as illustrated in FIGS. 2, 5, 6, and 7 in which the leading and/or trailing edges are curved inwardly into the vane 42 from the outer and inner annular end walls 38 and 40 at the tip 31 and the base 32, respectively, to leading and trailing edge points 78 and 79, respectively, between the end walls. Sweep for the purpose of this invention is the same as the sweep disclosed and defined in U.S. Pat. No. 5,167,489. Sweep is defined relative to incoming stream surfaces of a fluid flowable over the vane. Aerodynamic sweep is a conventional parameter represented by the inclination of an airfoil surface, such as a vane leading edge, in the direction of flow relative to an incoming axisymmetric stream surface 40. A positive sweep angle is indicative of a vane surface inclined in a downstream direction relative to the incoming axisymmetric stream surface such as in a swept-back vane. A vane surface disposed perpendicularly to the incoming axisymmetric stream surface has a sweep angle of 0 degrees. A negative sweep angle means the vane is inclined in an upstream direction relative to the axisymmetric stream surface for obtaining forward sweep of the blade. A more detailed definition of sweep and equations for determining aerodynamic sweep angle may be found in the U.S. Pat. No. 5,167,489 to Wadia et al., which is assigned to the present assignee and incorporated herein by reference.

Figure 7:
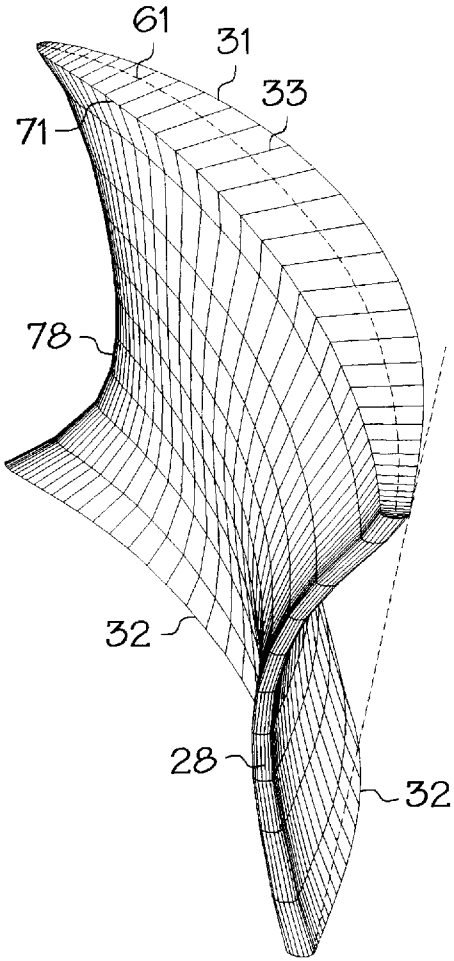
FIG. 7 is a wire frame schematic perspective view illustration from a trailing edge of the outlet guide vane of the assembly illustrated in FIG. 2.
Figure 6:
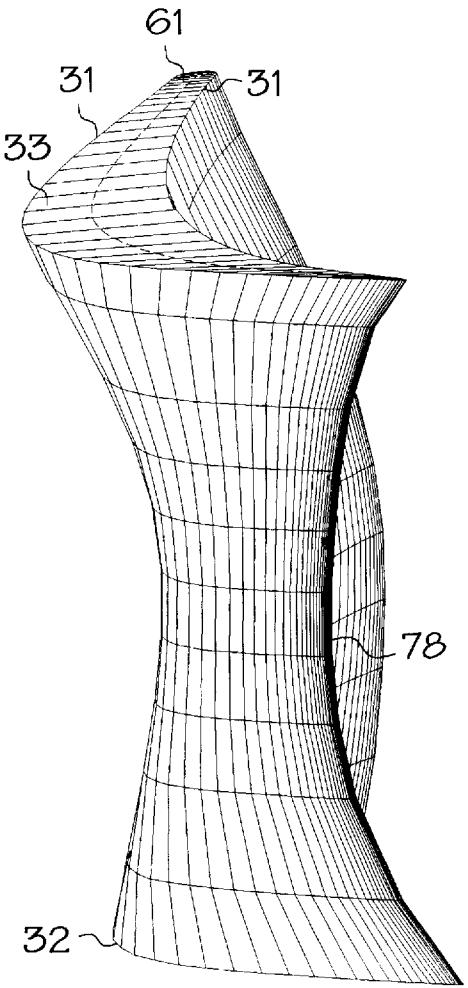
FIG. 6 is a wire frame schematic perspective view illustration from a leading edge of the outlet guide vane of the assembly illustrated in FIG. 2.

In another boundary layer energizing means, the OGVs 42 are bowed circumferentially outwardly and in the exemplary embodiment the OGVs are bowed outwardly in a circumferential direction the pressure side 54 is facing as illustrated in FIGS. 4, 6 and 7. Bowed OGVs 42 have a curved or bowed blade axis 77 as illustrated in FIG. 4. This provides acute angles 82 between the pressure side 54 and the outer and inner annular end walls 38 and 40 at the tip 31 and the base 32, respectively, of the OGVs 42. This also provides obtuse angles 84 between the suction side 56 and the outer and inner annular end walls 38 and 40 at the tip 31 and the base 32 of OGVs 42. In the exemplary embodiment of the invention illustrated herein, all of the individual boundary layer energizing means disclosed above are incorporated.

The present invention has been described in an illustrative manner. It is to be understood that the terminology which has been used is intended to be in the nature of words of description rather than of limitation. While there have been described herein, what are considered to be preferred and exemplary embodiments of the present invention, other modifications of the invention shall be apparent to those skilled in the art from the teachings herein and, it is, therefore, desired to be secured in the appended claims all such modifications as fall within the true spirit and scope of the invention.

Accordingly, what is desired to be secured by Letters Patent of the United States is the invention as defined and differentiated in the following claims:

What is claimed is:

1. A gas turbine engine compressor outlet guide vane assembly comprising:

annular inner and outer end walls, a flowpath between said inner and outer end walls, compressor outlet guide vanes radially disposed between said inner and outer end walls, and boundary layer energizing means for energizing boundary layers using secondary flow to mix free stream flow into the boundary layers along said inner and outer end walls and suction and pressure sides of said vanes.

2. An assembly as claimed in claim 1 wherein said pressure and suction sides are circumferentially leaned in a circumferential direction that said suction sides face.

3. An assembly as claimed in claim 1 wherein said vanes have leading and trailing edges that extend radially between said inner and outer end walls and at least one of said leading and trailing edges are swept.

4. An assembly as claimed in claim 1 wherein said vanes have leading and trailing edges that extend radially between said inner and outer end walls and at least one of said leading and trailing edges are swept and curved inwardly into said vanes from said inner and outer end walls to at least one of leading and trailing edge points respectively between said inner and outer end walls.

5. An assembly as claimed in claim 1 wherein said vanes are bowed circumferentially outwardly in a circumferential direction.

6. An assembly as claimed in claim 5 wherein said vanes are circumferentially leaned in a direction that said suction sides face.

7. An assembly as claimed in claim 5 wherein said vanes have leading and trailing edges that extend radially between said inner and outer end walls and at least one of said leading and trailing edges are swept and curved inwardly into said vanes from said outer end walls to at least one of leading and trailing edge points respectively between said end walls.

8. An assembly as claimed in claim 7 wherein said vanes are circumferentially leaned in a direction that said suction sides face.

9. An assembly as claimed in claim 5 wherein said vanes are bowed circumferentially outwardly in a circumferential direction that said pressure sides face.

10. An assembly as claimed in claim 9 wherein said vanes have leading and trailing edges that extend radially between said inner and outer end walls and at least one of said leading and trailing edges are swept and curved inwardly into said vanes from said outer end walls to at least one of leading and trailing edge points respectively between said end walls.

11. An assembly as claimed in claim 10 wherein said vanes are circumferentially leaned in a direction that said suction sides face.

12. An assembly as claimed in claim 1 wherein said flowpath diverges between leading and trailing edges of said vanes.

13. An assembly as claimed in claim 12 wherein at least one of said leading and trailing edges are swept.

14. An assembly as claimed in claim 12 wherein at least one of said leading and trailing edges are curved inwardly into said vanes from said outer end walls to at least one of leading and trailing edge points respectively between said end walls.

15. An assembly as claimed in claim 12 wherein said vanes are bowed circumferentially outwardly in a circumferential direction.

16. An assembly as claimed in claim 15 wherein said vanes are bowed circumferentially outwardly in a circumferential direction that said pressure sides face.

17. An assembly as claimed in claim 12 wherein said vanes are circumferentially leaned in a direction that said suction sides face.

18. An assembly as claimed in claim 17 wherein said vanes have leading and trailing edges that extend radially between said inner and outer end walls and at least one of said leading and trailing edges are swept.

19. An assembly as claimed in claim 18 wherein said at least one of said leading and trailing edges curved inwardly into said vanes from said outer end walls to one of leading and trailing edge points respectively between said end walls.

20. An assembly as claimed in claim 19 wherein said vanes are bowed circumferentially outwardly in a circumferential direction.

21. An assembly as claimed in claim 20 wherein said vanes are bowed circumferentially outwardly in a circumferential direction that said pressure sides face.

22. A gas turbine engine compressor outlet guide vane and diffuser assembly comprising:

integral compressor outlet guide vane and diffuser sections, annular inner and outer end walls radially bounding said sections, a flowpath between said inner and outer end walls, said outlet guide vane section located forward of said diffuser section, and said outlet guide vane section comprising compressor outlet guide vanes radially disposed between said inner and outer end walls and boundary layer energizing means for energizing boundary layers using secondary flow to mix free stream flow into the boundary layers along said inner and outer end walls and suction and pressure sides of said vanes.

23. An assembly as claimed in claim 22 wherein said flowpath diverges between leading and trailing edges of said vanes.

24. An assembly as claimed in claim 23 wherein;

said leading and trailing edges extend radially between said inner and outer end walls, said vanes are circumferentially leaned in a direction that said suction sides face, and at least one of said leading and trailing edges are swept.

25. An assembly as claimed in claim 24 wherein said at least one of said leading and trailing edges are curved inwardly into said vanes from said outer end walls to leading and trailing edge points respectively between said end walls.

26. An assembly as claimed in claim 25 wherein said vanes are bowed circumferentially outwardly in a circumferential direction.

27. An assembly as claimed in claim 26 wherein said vanes are bowed circumferentially outwardly in a circumferential direction that said pressure sides face.

28. An assembly as claimed in claim 23 further comprising annular flow separators in said diffuser section.

29. An assembly as claimed in claim 28 wherein said vanes are circumferentially leaned in a direction that said suction sides face and at least one of said leading and trailing edges are swept.

30. An assembly as claimed in claim 29 wherein said at least one of said leading and trailing edges are curved inwardly into said vanes from said outer end walls to at least one of leading and trailing edge points respectively between said end walls.

31. An assembly as claimed in claim 30 wherein said vanes are bowed circumferentially outwardly in a circumferential direction.

32. An assembly as claimed in claim 31 wherein said vanes are bowed circumferentially outwardly in a circumferential direction that said pressure sides face.

33. An assembly as claimed in claim 32 further comprising annular flow separators in said diffuser section.

34. An assembly as claimed in claim 33 further comprising struts extending radially across said flowpath between said inner and outer end walls in said diffuser section.

35. An assembly as claimed in claim 23 further comprising struts extending radially across said flowpath between said inner and outer end walls in said diffuser section.

36. An assembly as claimed in claim 35 further comprising annular flow separators in said diffuser section.

37. An assembly as claimed in claim 22 wherein said integral outlet guide vane and diffuser sections are integrally cast.

38. An assembly as claimed in claim 37 wherein: leading and trailing edges extend radially between said inner and outer end walls, said vanes are circumferentially leaned in a direction that said suction sides face, and at least one of said leading and trailing edges are swept.

39. An assembly as claimed in claim 38 wherein said at least one of said leading and trailing edges are curved inwardly into said vanes from said outer end walls to at least one of said leading and trailing edge points respectively between said end walls.

40. An assembly as claimed in claim 39 wherein said vanes are bowed circumferentially outwardly in a circumferential direction.

41. A gas turbine engine outlet guide vane assembly as claimed in claim 40 wherein said vanes are bowed circumferentially outwardly in a circumferential direction that said pressure sides face.

* * * * *